US006698437B2

(12) United States Patent
Höser et al.

(10) Patent No.: US 6,698,437 B2
(45) Date of Patent: Mar. 2, 2004

(54) CLEANING DEVICE FOR A SHAVING APPARATUS

(75) Inventors: Jürgen Höser, Neu-Anspach (DE); Alf Jahn, Halle/Saale (DE); Norbert Kreutz, Wehrheim (DE); Thomas Schamberg, Usingen (DE)

(73) Assignee: Braun GmbH (DE)

( * ) Notice: Subject to any disclaimer, the term of this patent is extended or adjusted under 35 U.S.C. 154(b) by 217 days.

(21) Appl. No.: 10/061,431

(22) Filed: Feb. 1, 2002

(65) Prior Publication Data

US 2002/0069902 A1 Jun. 13, 2002

Related U.S. Application Data

(63) Continuation of application No. PCT/EP00/07350, filed on Jul. 29, 2000.

(30) Foreign Application Priority Data

Aug. 6, 1999 (DE) ..... 199 37 166

(51) Int. Cl.[7] ..... B08B 3/02

(52) U.S. Cl. ..... 134/104.4; 134/110; 134/111; 134/135; 134/166 R; 134/182; 134/186

(58) Field of Search ..... 134/104.2, 104.4, 134/109, 110, 111, 116, 135, 166 R, 169 R, 182, 186, 188, 198, 201

(56) References Cited

U.S. PATENT DOCUMENTS 1,868,904 A * 7/1932 Johnston
2,441,229 A * 5/1948 Schultz
2,447,183 A * 8/1948 Irish et al.
2,573,008 A * 10/1951 Gorden
2,788,536 A * 4/1957 Loeffler
3,019,494 A * 2/1962 Hori et al.
3,365,267 A * 1/1968 Mekiney et al.
3,446,572 A * 5/1969 Souza
3,478,758 A * 11/1969 Davies
3,759,594 A * 9/1973 Cobb
3,971,394 A * 7/1976 Osborne
5,147,575 A * 9/1992 Hampton, Sr.
5,614,030 A * 3/1997 Braun
5,649,556 A * 7/1997 Braun
5,711,328 A * 1/1998 Braun
5,839,457 A * 11/1998 Rijken et al.
6,305,391 B1 * 10/2001 Hoser

FOREIGN PATENT DOCUMENTS

| | | |
|---|---|---|
| DE | 411288 | 3/1925 |
| DE | 19937167 | 3/2000 |
| WO | WO 80/02657 | * 12/1980 |
| WO | WO 98/35581 | 8/1998 |

* cited by examiner

*Primary Examiner*—Frankie L Stinson
(74) *Attorney, Agent, or Firm*—Fish & Richardson PC

(57) ABSTRACT

The invention is directed to a cleaning device (RV) for cleaning objects of personal use, in particular a shaving head (S) of a shaving apparatus (TR), with a housing (1) having a cleaning bath (8), with a cleaning liquid container (3) containing a cleaning liquid (11), with an integrated filter element (4) as well as with a liquid impelling assembly (6) adapted to be driven by a motor (5) and having a supply conduit (7) to the cleaning bath (8) and a draining conduit (9) to the cleaning liquid container (3), wherein all the walls of the cleaning bath (8) have an angle of inclination (α and β) in the direction of the draining conduit (9) which ensures that cleaning liquid (11), with or without contaminants, flows to the draining conduit (9).

13 Claims, 2 Drawing Sheets

CLEANING DEVICE FOR A SHAVING APPARATUS

This application is a Continuation of application No. PCT/EP00/07350 filed Jul. 29, 2000.

This invention relates to a cleaning device of the type identified in the prior-art portion of claim 1.

A cleaning device of the type initially referred to is known from PCT/EP98/00417.

It is an object of the present invention to improve a cleaning device of the type initially referred to.

According to the invention this object is accomplished by a cleaning device of the type initially referred to with the features of claim 1.

The cleaning device of the present invention has several advantages. One essential advantage of the invention is that, upon termination of a cleaning cycle, the cleaning liquid with contaminants therein in the cleaning bath is directed, as the result of the walls of the cleaning bath being suitably inclined, to the draining conduit for returning to the cleaning liquid container. The provided inclination of all the walls, particularly the bottom wall of the cleaning bath, in the direction of the draining conduit guarantees that the entire cleaning liquid with contaminants therein disengages from the walls of the cleaning bath and flows off into the cleaning liquid container.

According to an advantageous embodiment of the invention all the walls of the cleaning bath have an angle of inclination to a horizontal plane that guarantees that the downward drive force of the cleaning liquid, with or without contaminants, to the draining conduit exceeds the force of adhesion between the cleaning liquid and the walls. A further advantageous embodiment of the invention is characterized in that all the walls of the cleaning bath have an angle of inclination to a horizontal plane that guarantees that the downward drive force of the cleaning liquid to the draining conduit exceeds the surface tension of the cleaning liquid. Each of these provisions of the invention ensures that no cleaning liquid remains in the cleaning bath to evaporate. Consequently, a higher number of cleaning cycles can be performed with the cleaning liquid present in a cleaning liquid container. Completely draining the cleaning liquid out of the cleaning bath prevents the user of the cleaning device from being disturbed by the evaporation of alcohol components that are to be found in the cleaning liquid. The provided inclination of the cleaning bath causes an increase in the speed at which the cleaning liquid flows out of the cleaning bath to the extent that the cleaning liquid and the contaminants are unable to segregate. The result is a clean cleaning bath after the cleaning cycle has ended and the cleaning liquid with contaminants has drained off.

According to a preferred embodiment of the invention the cleaning bath is arranged at an angle of inclination $\alpha$ and $\beta$ to the horizontal plane in the housing. An essential advantage of this arrangement, which facilitates the manufacture of a cleaning device, is that the object to be cleaned is also accordingly set at an incline when the cleaning bath is set at an incline, thus promoting the draining of cleaning liquid from and out of said object, e.g., from the shaving head of a shaving apparatus that is to be cleaned.

According to a further embodiment of the invention, cleaning liquid is guaranteed to flow out of the cleaning bath by aligning the bottom of the cleaning bath in the direction of the draining conduit at an angle of inclination $\alpha$ to the horizontal plane.

This arrangement can be provided for an already inclined cleaning bath in order to increase the flow velocity of the cleaning liquid to the draining conduit, and guarantees particularly with a non-inclined cleaning bath that the cleaning liquid flows to the draining conduit.

According to a preferred embodiment of the invention provision is made for the junction between a side wall and a bottom wall of the cleaning bath to be constructed in arcuate shape in order to promote the flow velocity of draining cleaning liquid and to prevent contaminant deposits from the liquid.

On account of the numerous influencing variables needing to be taken into account, e.g., the surface tension and/or adhesive force and the composition of the cleaning liquid such as its content of, in particular, alcohol, lubricant, water and tensides, the magnitude of the angle of inclination of a cleaning bath set at an incline to a horizontal plane or of a bath bottom aligned at an angle to a horizontal plane, e.g., a non-inclined cleaning bath, has to be determined and specified for the respective embodiment by means of practical tests. Hence according to one embodiment of the invention the angle of inclination $\alpha$ and $\beta$ is variable by varying the surface tension of the cleaning liquid. According to a further embodiment the angle of inclination $\alpha$ and $\beta$ is variable by varying the adhesive force of the cleaning liquid. According to yet another embodiment of the invention an angle of inclination ensuring a sufficient flow velocity is variable by providing for the surface tension of the cleaning liquid to be variable chemically. Flow velocity and angle of inclination are also variable by providing for the adhesive force of the cleaning liquid to be variable chemically. In one embodiment of the invention provision is made to reduce the surface tension and/or adhesive force of the cleaning liquid by adding tensides to the cleaning liquid. In yet another embodiment of the invention provision is made to reduce the surface tension and/or adhesive force of the cleaning liquid by adding lubricants. Further advantages and details of the present invention will become apparent from the subsequent description of a preferred embodiment illustrated in the accompanying drawings.

Figure 1:
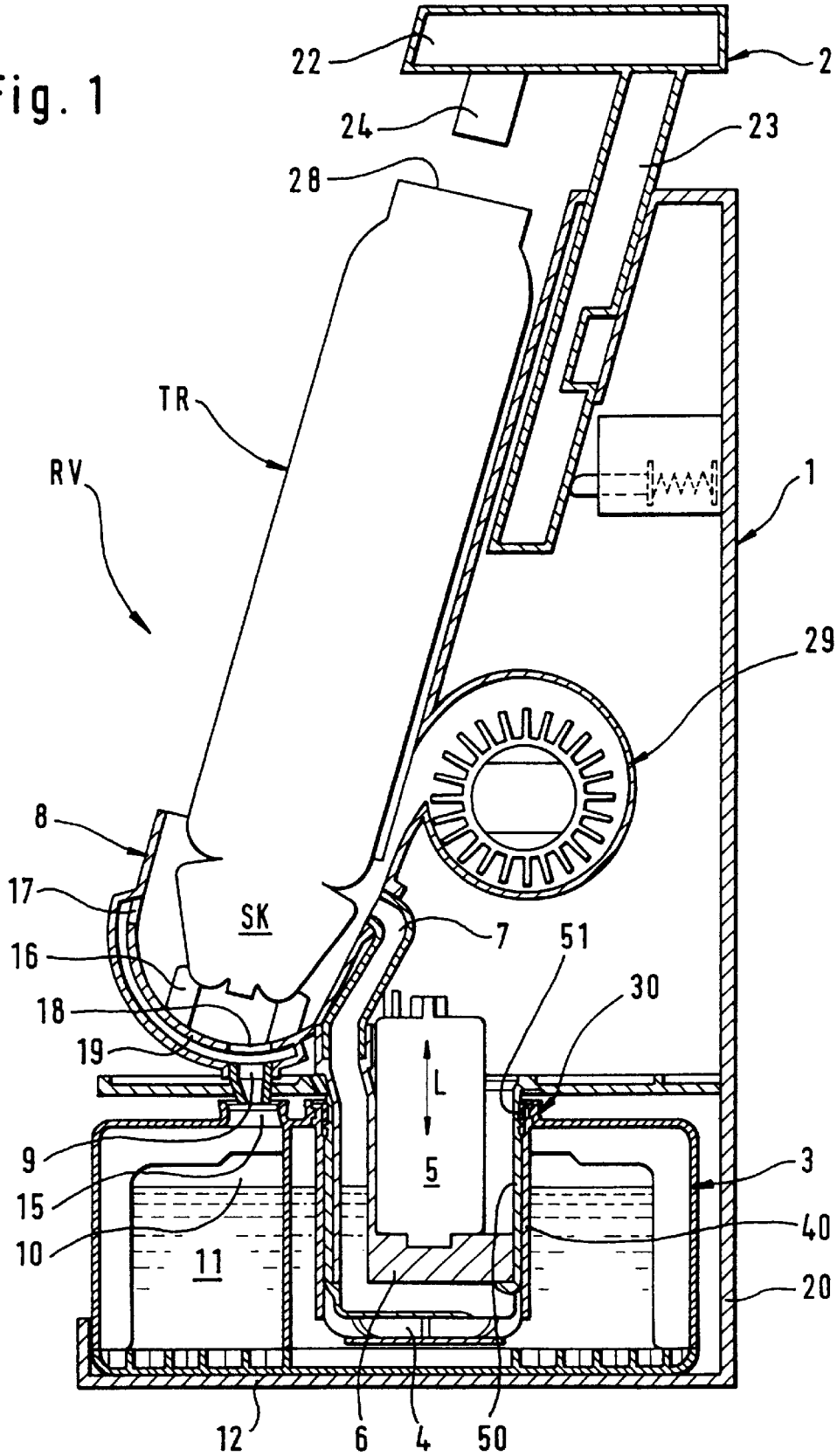
FIG. 1 is a cross sectional view of a cleaning device, comprising a cleaning liquid container with integrated filter beneath a cleaning bath, a liquid impelling assembly, a supply conduit to the cleaning bath in which a shaving head of a shaving apparatus is carried, and a draining conduit.

FIG. 1 shows a cleaning device RV for cleaning a shaving head S of a shaving apparatus TR, comprising a housing 1, a holding device 2, a cleaning liquid container 3, a filter element 4, a liquid impelling assembly 6 adapted to be driven by a motor 5 and having a supply conduit 7 leading to a cleaning bath 8 and a draining conduit 9 leading from the cleaning bath 8 to the cleaning liquid container 3. The cleaning liquid container 3 is arranged with an integrated filter element 4 underneath the cleaning bath 8 and above a wall 12 of the housing 1. The liquid impelling assembly 6 is arranged so that it can be removed from the interior 10 of the cleaning liquid container 3, meaning from the filter housing 40. Arranged between the filter housing 40 and the pump housing 50 is a sealing element 51 to prevent cleaning liquid 11 from flowing out of the cleaning liquid container 3.

The inner curvature of the cleaning bath 8 is shaped to conform approximately to the outer contour of the object to be cleaned, for example, the outer contour of a shaving head S of a shaving apparatus TR. The cleaning bath 8 receives only as much cleaning liquid 11 as is required for the respective cleaning operation. Two support elements 16 made of an elastic material, for example, can be provided to support the shaving head S at the bottom of the cleaning bath 8. The cleaning bath 8 has an overflow device 17 to prevent the cleaning liquid 11 in the cleaning bath from exceeding a defined level. The overflow device 17 guarantees that, when the cleaning device RV is in operation, the shaving head S or a part of the shaving head S is immersed in cleaning liquid 11, and prevents cleaning liquid 11 from flowing over the brim of the cleaning bath 8. In this embodiment the draining of the cleaning liquid 11 from the cleaning bath 8 to the cleaning liquid container 3 is guaranteed by the outlet port 18 in the draining conduit 9 in the bottom 19 of the cleaning bath 8, the drain cross section of which can also be used to control the level of the cleaning liquid in the cleaning bath, and by an inlet port 15 constructed, for example, as a funnel in the cleaning liquid container 3. To be able to move the replaceable cleaning liquid container 3, the inlet port 15 and the outlet port 30 in the cleaning liquid container 3 can be closed as by means of a closure—not shown.

The shaving apparatus TR is held in the cleaning bath 8 by an adjustably arranged holding device 2. The holding device 2 is essentially formed by a wall 23, which extends parallel to one broadside of the shaving apparatus TR, and by a wall 22 facing the base wall of the shaving apparatus TR. A retaining element 24 constructed as an appliance connector is provided on the wall 22. The wall 23 of the holding device 2, which is coupled to the wall 22, is slidably mounted in the housing 1, being movable for example, in a direction parallel to the housing broadside of the shaving apparatus TR, such that moving the holding device 2 in the direction of the cleaning bath 8 invariably results in the retaining element 24, which is constructed as an appliance connector, being coupled to the appliance socket 28 of the shaving apparatus TR, and moving the holding device 2 in the opposite direction invariably results in the holding device 2 being uncoupled from the shaving apparatus TR. Coupling the appliance connector of the retaining element 24 to the appliance socket 28 effects, via connection to the electric circuit provided in the cleaning device RV for operating the liquid impelling assembly 6 and/or the fan 29, the supply of an electric voltage for a variety of purposes including, for example, a manually operated or automatically controlled actuation of the electric drive of the shaving apparatus TR when the cleaning device RV is switched on, and/or a recharging of a shaving apparatus TR, which is equipped with a rechargeable storage cell, after the cleaning device RV is switched off. Putting the shaving apparatus TR into operation during the cleaning cycle promotes, as a result of the oscillating movement of a cutting element provided in the shaving head S of the shaving apparatus TR and the ensuing agitation of the cleaning liquid 11 in the shaving head S, the cleaning effect of the cleaning liquid 11.

Provided in the cleaning device RV is a fan 29 that supplies air to dry the shaving head S, shown by way of example, after cleaning is completed, i.e., after the cleaning liquid 11 is drained from the cleaning bath 8. Activation and deactivation of the fan 29 can be controlled as part of an operating program of a programmable switching device—not shown—and/or separately by hand.

Figure 2:
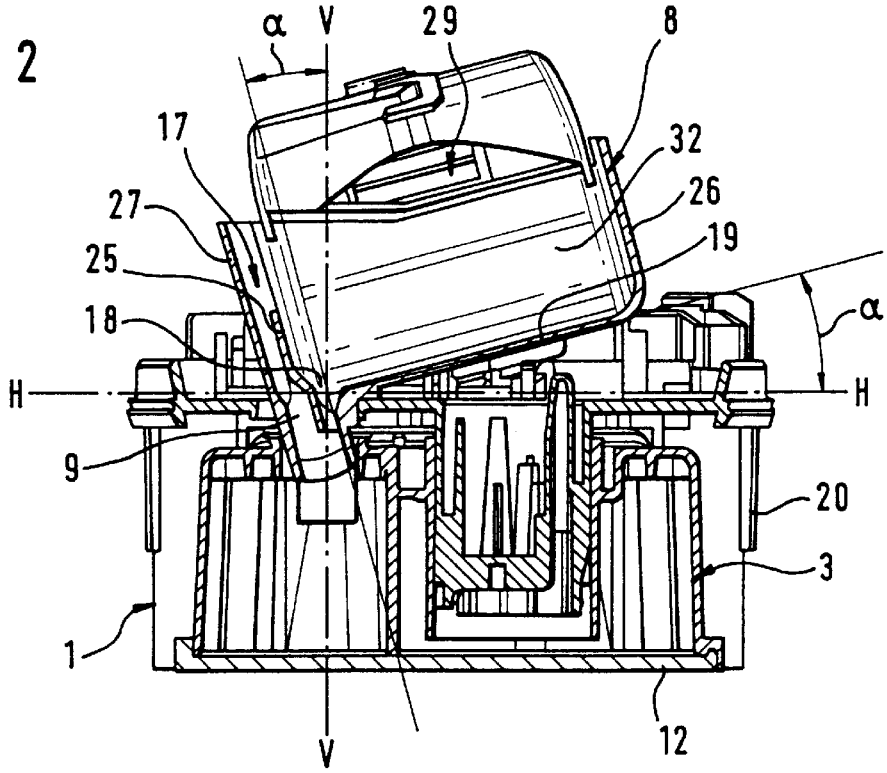
FIG. 2 is a longitudinal sectional view of the lower part of a cleaning device, in particular of a cleaning bath and a cleaning liquid container with integrated filter and a fan wheel for drying an object to be cleaned.

FIG. 2 shows a side view of the cleaning device RV with a section through the chassis 20 of the housing 1 at a cleaning liquid container 3 arranged on the chassis 20 and at a cleaning bath 8 arranged at an angle to a horizontal plane H on the chassis 20. The angle of inclination of the cleaning bath 8 as well as of the bottom 19 of the cleaning bath 8 to the horizontal plane H is identified with $\alpha$. The outlet port 18 of the draining conduit 9 in the bath bottom 19 lies at the point where the horizontal plane H intersects with a line of inclination of the angle of inclination $\alpha$. In the embodiment illustrated in FIG. 2 the draining conduit 9 is divided by a wall 25 of the overflow device 17 into two opening areas, with the opening in the bath bottom 19 in front of the wall 25 of the overflow device 17 being dimensioned such that the cleaning liquid, which contains contaminants, can be drained unobstructed into the cleaning liquid container 3 without clogging said opening. The section through the cleaning bath 8 clearly reveals that, like the inclined bath bottom 19, the two end walls 26, 27 of the cleaning bath 8 also extend at an angle to the horizontal plane H, hence guaranteeing that cleaning liquid is also drained from these end walls 26, 27 of the cleaning bath 8. Provided behind the illustrated longitudinal side wall 32 of the cleaning bath 8 of the cleaning device RV is a fan 29 for drying an object to be cleaned.

Figure 3:
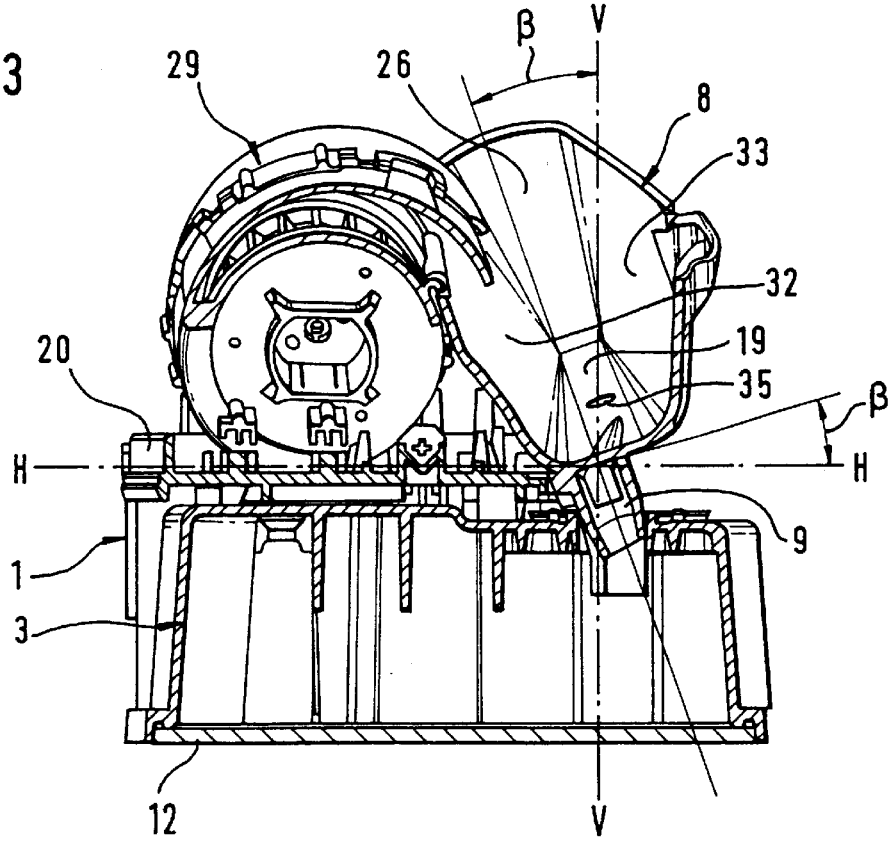
FIG. 3 is a cross sectional view of the lower part of the cleaning device of FIG. 2, with a section through the cleaning bath in the area of the draining conduit.

FIG. 3 shows a section through the components of the cleaning device RV where said components are illustrated in FIG. 2. The section extends transversely through the chassis 20 of the housing 1 of the cleaning liquid container 3 as well as transversely through the cleaning bath 8, which is arranged at an angle to a horizontal plane H on the chassis 20, and through the fan 29 mounted on the chassis 20 behind the cleaning bath 8. Provided in the bottom 19 of the cleaning bath 8 is an opening 35 through which the cleaning liquid 11 is supplied to the cleaning bath 8 via the supply conduit 7 (see FIG. 1).

The bath bottom, 19, the rear longitudinal side wall 32 and the front longitudinal side wall 33, as well as an end wall 26 joining both, are made visible by the cross section through the cleaning bath 8. The junctions between the longitudinal side wall 32, the longitudinal side wall 33, the end walls 25, 26 and the bath basin 19 are constructed in arcuate shape so that, on termination of the cleaning cycle, the cleaning liquid 11 with contaminants therein is allowed to flow unobstructed to the draining conduit 9 to be drained into the cleaning liquid container 3. All the walls of the cleaning bath 8, particularly the bath bottom 19, extend at an angle to a horizontal plane H, with the angle of inclination of the bath bottom 19 to the horizontal plane H being defined by the angle of inclination $\beta$.

The cleaning liquid 11 can be made to flow at a sufficient velocity to the outlet port 18 by setting the bottom 19 of the bath at an incline with an angle of inclination $\alpha$ of over 5°, preferably 10° to 20°. The angle of inclination $\alpha$ required in the specific case is dependent on various influencing variables such as the angle of inclination $\beta$ of the bath bottom 19, which, as shown by way of example, has a planar component—see FIG. 3—or else can be totally constructed in arcuate shape—not illustrated. The angle of inclination $\beta$ lies preferably in a range from 5° to 20° as well. On account of the bath shape the longitudinal side walls 32, 33 and the end walls 26, 27 merging into the bath bottom 19 have an angle of inclination of over 20°, thus ensuring that the cleaning liquid 11 flows off said walls, provided that the downward drive force of the cleaning liquid 11 exceeds the surface tension and/or adhesive force of the cleaning liquid on the walls of the cleaning bath 8.

The adhesive force of the cleaning liquid 11 on the walls of the cleaning bath 8 can be reduced by giving the inner wall surface of the cleaning bath a suitable consistency, meaning that said surface is made to be preferably smooth or highly polished.

The surface tension of the cleaning liquid 11 should be relatively low in order to encourage the cleaning liquid 11 with contaminants therein to disengage from the inner walls of the cleaning bath 8. A low density of the cleaning liquid will prevent contaminants from floating to the surface while the cleaning liquid 11 drains into the cleaning liquid container 3 and, given the provided flow velocity of the cleaning liquid 11, it will also prevent dirt from leaving marks particularly on the inner walls of the cleaning bath, and contaminants, such as hairs removed from the shaving head S of the shaving apparatus TR, from sinking to the bottom.

The surface tension and/or the adhesive force of the cleaning liquid 11 can be influenced via the chemical composition of the cleaning liquid as well as by increasing or decreasing one or several constituents such as the content of alcohol, tensides, lubricants and odorants.

What is claimed is:

1. A cleaning device (RV) for cleaning objects of personal use, comprising:

a housing;

a cleaning bath in the housing;

a cleaning liquid container for containing a cleaning liquid, said liquid container including an integrated filter element, a motor, a liquid impelling assembly adapted to be driven by said motor, and a supply conduit to the cleaning bath, wherein the cleaning bath includes a draining conduit to the cleaning liquid container, wherein the cleaning bath has a bottom wall and side walls extending up from the bottom wall, all of the bottom and side walls of the cleaning bath being inclined at an angle of inclination relative to a horizontal plane so as to ensure that cleaning liquid, with or without contaminants, flows to the draining conduit.

2. The cleaning device (RV) as claimed in claim 1, wherein the bottom wall and all of the side walls of the cleaning bath are inclined relative to the horizontal plane so as to guarantee that a downward drive force of the cleaning liquid, with or without contaminants, to the draining conduit exceeds a force of adhesion between the cleaning liquid and any of the above-mentioned walls of the cleaning bath.

3. The cleaning device (RV) as claimed in claim 2, wherein all the above-mentioned walls of the cleaning bath are inclined relative to the horizontal plane so as to cause that the downward drive force of the cleaning liquid, with or without contaminants, to the draining conduit exceeds the surface tension of the cleaning liquid.

4. The cleaning device (RV) as claimed in claim 1, wherein the cleaning bath is inclined relative to the horizontal plane in the housing.

5. The cleaning device (RV) as claimed in claim 1, wherein the bottom wall of the cleaning bath is aligned in the direction of the draining conduit and is inclined relative to the horizontal plane.

6. The cleaning device (RV) as claimed in claim 1, wherein the side walls include an end wall and a longitudinal side wall and wherein the bottom wall of the cleaning bath forms a junction with one of the end wall and the longitudinal side wall, said junction being of arcuate shape.

7. The cleaning device (RV) as claimed in claim 1, wherein the angle of inclination is variable by varying the surface tension of the cleaning liquid.

8. The cleaning device (RV) as claimed in claim 1, wherein the angle of inclination is variable by varying the adhesive force of the cleaning liquid.

9. The cleaning device (RV) as claimed in claim 1, wherein the bottom wall has an angle of inclination of $\alpha$ and one of the side walls has an angle of inclination of $\beta$ and wherein the angles of inclination $\alpha$ and $\beta$ are of different magnitude.

10. The cleaning device (RV) as claimed in claim 1, wherein the cleaning liquid is in the liquid container and the surface tension of the cleaning liquid is variable chemically.

11. The cleaning device (RV) as claimed in claim 1, wherein the cleaning liquid is in the liquid container and the adhesive force of the cleaning liquid is variable chemically.

12. The cleaning device (RV) as claimed in claim 1, wherein the cleaning liquid is in the liquid container and at least one of the surface tension and the adhesive force of the cleaning liquid is reducible by the addition of tensides to the cleaning liquid.

13. The cleaning device (RV) as claimed in claim 1, wherein the cleaning liquid is in the liquid container and at least one of the surface tension and the adhesive force of the cleaning liquid is reducible by the addition of lubricants.

* * * * *